US011795621B2

(12) United States Patent
Lascar et al.

(10) Patent No.: US 11,795,621 B2
(45) Date of Patent: Oct. 24, 2023

(54) METHOD FOR DEPOSITING A CELLULOSIC FIBER COMPOSITION ON A SUBSTRATE

(71) Applicant: KADANT LAMORT, Vitry le Francois (FR)

(72) Inventors: Alain Lascar, Saint Maurice (FR); Stéphan Pottier, Couvrot (FR)

(73) Assignee: KADANT LAMORT, Vitry le Francois (FR)

( * ) Notice: Subject to any disclaimer, the term of this patent is extended or adjusted under 35 U.S.C. 154(b) by 179 days.

(21) Appl. No.: 17/601,369

(22) PCT Filed: Mar. 18, 2020

(86) PCT No.: PCT/EP2020/057420
§ 371 (c)(1),
(2) Date: Oct. 4, 2021

(87) PCT Pub. No.: WO2020/207727
PCT Pub. Date: Oct. 15, 2020

(65) Prior Publication Data

US 2022/0195670 A1 Jun. 23, 2022

(30) Foreign Application Priority Data

Apr. 9, 2019 (FR) ..... 1903778

(51) Int. Cl.
*D21H 19/52* (2006.01)
*D21H 19/38* (2006.01)
*D21H 23/50* (2006.01)

(52) U.S. Cl.
CPC ..... *D21H 19/52* (2013.01); *D21H 19/385* (2013.01); *D21H 23/50* (2013.01)

(58) Field of Classification Search
CPC ..... D21H 9/52; D21H 9/385; D21H 3/50
USPC ..... 162/135
See application file for complete search history.

(56) References Cited

U.S. PATENT DOCUMENTS 6,620,349 B1 * 9/2003 Lopez ..... C08L 97/02 252/607
2015/0240087 A1 8/2015 Van Moorsel

FOREIGN PATENT DOCUMENTS

| | | | |
|---|---|---|---|
| EP | 0681600 | A1 | 11/1995 |
| JP | 2019023360 | A | 2/2019 |
| WO | WO-9417147 | A1 | 8/1994 |
| WO | WO-2005007984 | A1 | 1/2005 |
| WO | WO-2016050986 | A1 | 4/2016 |

OTHER PUBLICATIONS

International Search Report and Written Opinion issued in PCT Patent Application No. PCT/EP2020/057420, dated May 20, 2020.
Beneventi, D. et al., "Pilot-scale elaboration of graphite/microfibrillated cellulose anodes for Li-ion batteries by spray deposition on a forming paper sheet," *Chemical Engineering Journal*, 243, pp. 372-379 (Jan. 21, 2014).
Shanmugam, Kirubanandan, et al., "Rapid preparation of smooth nanocellulose films using spray coating," *Cellulose* (May 10, 2017).
Shanmugam, Kirubanandan, et al., "Flexible spray coating process for smooth nanocellulose film production," *Cellulose*, (Feb. 2, 2018).

* cited by examiner

*Primary Examiner* — Mark Halpern
(74) *Attorney, Agent, or Firm* — MARSHALL, GERSTEIN & BORUN LLP

(57) ABSTRACT

A method for depositing, on a substrate, a composition of cellulosic fibers, includes preparing an aqueous suspension SA comprising at least cellulosic fibers, spraying, at a pressure no lower than 3 MPa, the aqueous suspension SA onto a substrate, wherein the spraying is carried out by means of a nozzle having a size between 0.05 mm and 3 mm, and obtaining a fibrous deposit DF on the substrate. The aqueous suspension SA includes at least 3% by weight of cellulosic fibers relative to the total weight of the aqueous suspension SA, and the aqueous suspension SA and the fibrous deposit DF have dry matter with identical composition.

13 Claims, 2 Drawing Sheets

METHOD FOR DEPOSITING A CELLULOSIC FIBER COMPOSITION ON A SUBSTRATE

This Application is a 371 of PCT/EP2020/057420 filed 18 Mar. 2020

FIELD OF TECHNOLOGY

The present invention relates to a method for depositing, on a substrate, a cellulosic fiber composition with possible mineral fillers.

This method makes it possible to deposit a composition having low grammage, ranging from 0.1 g/m$^2$ to a few grams of cellulosic fibers with or without mineral fillers.

The scope of use of the present invention relates in particular to packaging or composite biomaterials, and more generally to the paper and cardboard industry.

BACKGROUND

Conventional methods for manufacturing a single-ply sheet of paper or cardboard consist of depositing an aqueous suspension of cellulosic fibers onto a forming fabric, from which the water needs to be removed/drained (transport media), and of drying this deposit in order to form a sheet of paper or cardboard.

A multi-ply comprising a sheet of paper or cardboard can be prepared in accordance with this same embodiment, by depositing (applying) onto a first suspension of cellulosic fibers deposited on a fabric, (successively) one or more other highly diluted suspensions (commonly less than 15 g/L) of cellulosic fibers.

In the same way as a single-ply paper or cardboard, the formation of a multi-ply is achieved by assisted dewatering/drainage of the various layers, successive or not, and by final common drying to form the multi-ply sheet of paper or cardboard.

Assisted dewatering/drainage is not natural, it is forced in particular by "suction systems". This leads to a loss of material, essentially fine elements, since retention is never complete, even if it can be improved chemically by "retention agents" in particular.

This embodiment is only carried out using diluted suspension(s), usually less than 10 g/L of cellulosic fibers, or even less than 15 g/L in specific cases.

The addition of material or additives used to form, or to obtain specific properties of the sheet, whether single- or multi-ply, can be carried out:

during (and/or prior to) sheet formation, i.e. in admixture with one or more highly diluted suspensions of cellulosic fibers (commonly less than 10 to 15 g/L) deposited on the one or more various fabrics for forming the multi-ply or single-ply sheet of paper or cardboard. This method for adding matter or materials allows the addition of additives of similar size or smaller than the cellulosic fibers contained in the one or more suspensions, still highly diluted.

after sheet formation, by conventional so-called "coating" processes such as, for example, curtain coating or by coating processes such as size-press. Coating is commonly used to prepare printing and writing paper. This technique makes it possible to cover one or both sides of a sheet with a layer of small (colloidal) or dissolved fillers or particles, e.g. pigments. It makes it possible to modify the visual appearance of the sheet (whiteness, color, gloss) or its feel or print quality properties.

by inserting a thin layer of water, between two plies of a multi-ply, in the headbox of a paper machine. This method can be used in the preparation of laminated paperboard, with low-concentration, generally less than 5 g/L of fibers.

These embodiments involve draining and drying the upper layers of the multi-ply.

The present invention makes it possible to solve the problems of the prior art (drainage, viscosity, retention, etc.) by means of a method that does not involve drainage elements or tables for removing water and for forming one ply of a multi-ply. The present invention makes it possible to deposit very low grammages of cellulosic fibers, with or without mineral fillers, directly on a substrate, without involving the prior formation of a sheet. The present invention is not limited to the deposition of fibrils and to the use of compositions with a low concentration of fibers and/or fibrils.

SUMMARY OF THE DISCLOSURE

The present invention relates to a method for depositing, on a substrate, a composition based on cellulose fibers and possibly mineral fillers. This deposition is carried out by spraying forming a fibrous network.

The method according to the invention is advantageously carried out without drainage/dewatering and with no pre-forming step(s). Conversely, document WO2016/050986 describes a method that consists of depositing, on a filtration membrane, a suspension containing 2% by weight or less of cellulose fibrils. The fibrils have a diameter between 20 and 60 nm and a length between 0.5 and 5 μm. After forced or assisted drainage this deposit is transferred, in a wet state, onto a sheet of paper or cardboard. The multi-ply thus obtained is then dried. This method therefore involves the drainage of the suspension forming the top layer. In addition, it can lead to the loss of dry matter, for example mineral fillers, during the formation of the upper layer, in particular due to the drainage stage (generally forced by "negative pressure").

According to the present invention, the absence of drainage/dewatering and sheet pre-formation makes it possible to obtain a fibrous deposit having the same composition, in terms of dry matter, as the fibrous suspension used to carry out this deposit.

According to a first embodiment, the present invention relates to a method for depositing, on a substrate, a composition of cellulosic fibers, comprising the following steps:

1/ preparing an aqueous suspension SA comprising at least cellulosic fibers,

2/ spraying, at a pressure no lower than 3 MPa, the aqueous suspension SA onto a substrate, wherein the spraying is carried out by means of a nozzle having a size between 0.05 mm and 3 mm, 3/ obtaining a fibrous deposit DF on the substrate, the aqueous suspension SA comprising at least 3% by weight of cellulosic fibers relative to the total weight of the aqueous suspension SA, the aqueous suspension SA and the fibrous deposit DF having dry matter with identical composition.

According to a second embodiment, the present invention relates to a method for forming, on a substrate, a barrier layer comprising the following steps:

1'/ preparing an aqueous suspension SA comprising at least 3% by weight of cellulosic fibers relative to the total weight of the aqueous suspension SA, 2'/ depositing by spraying, at a pressure no lower than 3 MPa, the aqueous suspension SA onto a substrate, wherein the spraying is carried out by means of a nozzle having a size between 0.05 mm and 3 mm, 3'/ obtaining a barrier layer made up of a fibrous deposit DF on the substrate, the aqueous suspension SA and the fibrous deposit DF having dry matter with identical composition.

Whether for the first embodiment or the second embodiment, the aqueous suspension SA, the substrate and the fibrous deposit DF have the properties specified below.

Step 1/ or 1'/

The aqueous suspension SA comprises at least cellulosic fibers and water. It advantageously comprises between 3 and 20% by weight of cellulosic fibers relative to the total weight of the aqueous suspension SA, more advantageously between 3 and 20%, and even more advantageously between 4 and 10%.

For 100 parts by weight, the aqueous suspension SA can comprise between 50 and 97 parts of water, more advantageously between 80 and 97 parts, and even more advantageously between 80 and 96 parts.

Thus, advantageously, the aqueous suspension SA comprises, for 100 parts by weight, between 3 and 50 parts of dry matter, more advantageously between 3 and 20 parts, and even more advantageously between 4 and 20 parts.

The dry matter corresponds to the dry extract of the composition when the water has been removed, for example after drying at a temperature of 80° C. for a period of 45 minutes. It includes in particular cellulosic fibers and, where appropriate, mineral fillers and/or possible additives. As already mentioned, the dry matter composition of the aqueous suspension SA corresponds to the composition of the dry matter of the fibrous deposit DF.

Conveniently, the cellulosic fibers used in the present invention have an average length advantageously between 50 μm (50 micrometers) and 5 mm (5 millimeters), more advantageously between 50 μm and 3 mm. More advantageously, they have an average length no shorter than 100 μm, and even more advantageously no shorter than 200 μm. More advantageously, the cellulosic fibers can have an average length between 100 micrometers and 400 micrometers.

Length is understood to refer to the largest dimension of the cellulosic fibers.

The dimensions of the fibers, in particular their length, can be measured using conventional techniques, for example by means of a fiber morphology analyzer, such as a MorFi-type analyzer.

The cellulosic fibers are advantageously wood fibers. They can come from paper and/or cardboard recycling sources.

As already mentioned, the aqueous suspension SA advantageously comprises, for 100 parts by weight, between 3 and 50 parts by weight of dry matter. The dry matter comprises at least cellulosic fibers.

Conveniently, for 100 parts by weight of dry matter of the aqueous suspension SA, the cellulosic fibers may account for 3 to 100 parts by weight, or 3 to 20 parts, or 3 to 30 parts, or 3 to 40 parts, or even 3 to 50 parts.

As already mentioned, the aqueous suspension SA, and thus the fibrous deposit DF, can comprise mineral fillers. These fillers are advantageously selected from the group comprising calcium carbonate, kaolin and titanium dioxide.

The mineral fillers have an average size advantageously smaller than 100 micrometers, more advantageously between 1 μm and 100 μm, even more advantageously between 1 micrometer and 50 micrometers, and even more advantageously between 1 micrometer and 10 micrometers. When the mineral fillers are in the form of agglomerates, they can advantageously have a size between 15 micrometers and 50 micrometers.

The size of the mineral fillers corresponds to the largest dimension of a cross-section of a filler, for example the diameter for spherical fillers.

Advantageously, for 100 parts by weight of dry matter of the aqueous suspension SA, the mineral fillers can account for 0 to 97 parts by weight, or 5 to 70 parts by weight, or 5 to 60 parts, or 5 to 40 parts, or 5 to 30 parts, or 5 to 20 parts, or even 3 to 10 parts.

A person skilled in the trade would know how to adjust the amount of fillers according to the amount of cellulosic fibers and possible additives, in particular when the dry matter comprises (for 100 parts by weight) 3 to 100 parts by weight of cellulosic fibers, or 3 to 20 parts, or 3 to 30 parts, or 3 to 40 parts, or even 3 to 50 parts.

The aqueous suspension SA can optionally comprise cellulosic fibers with a size of less than 50 microns such as nanocellulose and/or cellulose microfibrils, advantageously between 50 parts and 90 by weight for 100 parts by weight of cellulosic fibers, more advantageously between 5 and 50 parts.

The aqueous suspension SA can likewise comprise additives, for example starch or a binder such as a latex or any other conventional coating additive. For 100 parts by weight of dry matter of SA, the additives (excluding the cellulosic material and the mineral fillers) may account for 0 to 90 parts by weight, or 5 to 70 parts by weight.

Once prepared, the aqueous suspension SA is used in step 2/ or 2'/.

Step 2/ or 2'/

This step (2/ or 2'/) consists of depositing by spraying the aqueous suspension SA onto a substrate.

This substrate is advantageously based on cellulosic fibers and, optionally, mineral fillers. It may in particular consist of paper or cardboard. In this case, one or both sides of the paper or cardboard may be partially or completely covered. Thus, the present invention may allow the formation of a multi-ply.

During step 2/ or 2', the substrate can be dry, wet or damp. Thus, the aqueous suspension SA can be sprayed onto paper, or cardboard, already formed or in the process of being formed, for example at the wet end of a paper machine.

However, the spraying is advantageously carried out on a semi-dry substrate, i.e. on a wet substrate, for example on paper or cardboard, in the process of being formed. Wet substrate means a substrate comprising at least 15% by weight of cellulosic fibers and/or mineral fillers and 85% or less, by weight, of water.

According to another special embodiment, the aqueous suspension SA can be deposited on a silicone or polyethylene fluoride (Teflon®) substrate. In this case, the fibrous deposit can be recovered, in particular after drying, for example in an oven, or even in the open air.

Spraying at a pressure no lower than 3 MPa makes it possible to form microdroplets from a composition, even if it is highly viscous. The application of a high pressure in combination with a small cross-section of the spray nozzle accelerates the speed of movement of the aqueous suspension SA and thus overcomes not only the viscosity-related flow resistance of the aqueous suspension SA (especially since it is thixotropic or shear-thinning) but also the surface tension of the aqueous suspension SA. When the pressurized aqueous suspension SA passes through a spray nozzle, it exits as a compact, dense stream which, when it comes into contact with air, breaks up finely to form microdroplets. The size of these microdroplets is advantageously between 1 and 800 μm, more advantageously between 10 and 250 micrometers.

Thanks to the formation of microdroplets of the aqueous suspension SA, spraying at a pressure no lower than 3 MPa allows the formation of a homogeneously distributed deposit even at low grammage (advantageously from 0.1 to 50 $g/m^2$). This method of spraying at a pressure no lower than 3 MPa makes it possible to deposit a cellulosic fiber composition in an optimal homogeneous manner.

It should be noted that conventional spraying is generally carried out at a pressure of less than 0.5 MPa (5 bar). It does not allow the formation of a homogeneous deposit when the aqueous suspension SA comprises more than 2% of cellulosic fibers, by weight relative to the total weight of the aqueous solution. These conditions lead to the formation of coarse drops when spraying the composition and thus to the formation of clumps of matter. This heterogeneity is attenuated by the amount of suspension that is sprayed.

The present invention makes it possible to avoid this pitfall by spraying at a pressure no lower than 3 MPa. As an example, the size of the droplets resulting from conventional spraying is generally between 1000 and 6000 micrometers, more particularly between 2000 and 5000 micrometers.

Also, the spraying methods of the prior art spray a composition containing solid particles that are 6 to 10 times smaller than the opening calibrating the spray, since a person skilled in the art would obviously deal with the clogging of the spray nozzle.

Without being linked to any theory, the Applicant considers that this hurdle has been overcome due to the flexibility of the cellulosic fibers which, when sprayed in suspension, can deform under the pressure of the spray and the rheology of the aqueous suspension SA.

Unlike conventional paper or cardboard manufacturing methods, and unlike conventional spray coating, spraying does not require drainage/dewatering. It does not require a dewatering system, by water suction or by vacuum effect, let alone a forming fabric. Thus, the method according to the invention is advantageously carried out without a drainage/dewatering step. This aspect also guarantees an optimal retention of the additives involved, thus allowing optimized control and deposited amount. Thus, the composition of the fibrous deposit DF is identical, in terms of dry matter, to the composition of the aqueous suspension SA that is sprayed. Only the amount of water distinguishes the composition of the fibrous deposit DF from the composition of the aqueous suspension SA.

In addition, spray coating is not only suitable for depositing fibers with sizes no smaller than 80 μm, but also for depositing a composition containing more than 2%, by weight, of cellulosic fibers relative to the total weight of the aqueous suspension. Spray coating requires final drainage by "rapid Kothen" or forced dewatering (suction). It is carried out at low pressure.

Spraying, at a pressure no lower than 3 MPa, allows the formation of a fibrous deposit DF which does not shrink during drying, regardless of its grammage (weight per surface unit e.g. $g/m^2$) and composition.

Conveniently, the spraying (step 2/ or 2'/) is carried out by means of a nozzle with a size similar, advantageously equal, to the length of the cellulosic fibers of the aqueous suspension SA.

The spraying is carried out by means of a nozzle having a size between 0.05 millimeters and 3 millimeters. The size of the spray nozzle is advantageously between 0.1 and 2.5 millimeters, more advantageously between 0.2 and 2 millimeters, more advantageously between 0.4 millimeter and 1.2 millimeters, even more advantageously between 0.5 millimeter and 0.8 millimeter.

The spraying conditions (pressure of 3 MPa or more and small nozzle 0.05-3 mm) generate the shearing of aqueous suspension SA. Upon shearing, aqueous suspension SA is less viscous and can be sprayed due to its thixotropic behavior. The viscosity of aqueous suspension SA decreases upon shearing and returns to the original viscosity or increases with time when shearing ends.

The spraying conditions therefore result in the shearing of the SA suspension and make it less viscous. However, it does not cut, refine or fibril the fibers.

These conditions (spraying pressure+nozzle size) further distinguish the invention from conventional spray coating methods.

In the absence of shearing, it is not possible to spray aqueous suspensions of more than 2.5 wt % fibers due to their viscosity.

According to the invention, the nozzle may have any shaped orifice. For instance, the nozzle may have a closed circular orifice (o-ring shaped orifice—hollow cone spray), an open circular orifice (full disc shape—round spray), a rectangular orifice (flat spray), a tapered-edge rectangular orifice (flat spray with tapered ends).

The nozzle size refers to the largest dimension of the nozzle, for instance the diameter of an open circular orifice nozzle or the length of a rectangular orifice nozzle.

The ratio between the size of the spray nozzle and the average size of the cellulosic fibers is advantageously between 1 and 6, more advantageously between 2 and 4. This ratio is particularly suitable when the aqueous suspension SA does not comprise components (mineral fillers, additives, etc.) having a size larger than the average size of the cellulosic fibers.

Spray deposition makes it possible to partially or completely cover at least one surface of the substrate or one of its layers when the substrate is a multi-ply paper or cardboard.

Spraying makes it possible to avoid any clumps or clots of cellulosic fibers, as the deposit is carried out without physical contact with any tool. Spraying therefore provides an undeniable advantage over coating/sizing techniques that do not use cellulosic fibers in their compositions.

Generally speaking, spraying can be carried out on a moving substrate, for example a conveyor belt. A person skilled in the art will therefore adjust the speed of the substrate and/or the flow rate and/or the water content of the aqueous suspension SA sprayed, all based on the desired grammage and/or the distance at which the spraying takes place.

Nevertheless, spraying is advantageously carried out by means of a stationary (possibly swiveling) device on a substrate moving at a speed between 5 and 1500 m/min.

On the other hand, when spraying, it is possible to direct the sprayed jet, for example in order to improve the coating of complex substrates.

Spraying is advantageously carried out without air.

The spraying pressure is advantageously between 3 MPa and 50 MPa (30 to 500 bar), more advantageously between 3 MPa and 30 MPa (30 to 300 bar), and even more advantageously between 4 MPa and 10 MPa (40 to 100 bar) (10 bar=1 MPa=$10\times10^5$ Pa).

The spray rate is advantageously between 0.5 and 10 L/min of aqueous suspension A, more advantageously between 1 and 5 L/min.

Advantageously, spraying makes it possible to deposit 0.1 to 50 g/m$^2$ of dry matter to form the fibrous deposit DF of step 3/ or 3'/.

Step 3/ or 3'/

The fibrous deposit DF has an advantageously homogeneous composition. This relates to the distribution within the deposit of the cellulosic fibers and, possibly, of the mineral fillers. Thus, the fibrous deposit DF can, due to its homogeneity, form a film. This film can be handled, in particular when the substrate is like silicone or fluorinated ethylene propylene.

It also has a contour effect since it completely follows the shape of the substrate.

Conveniently, the fibrous deposit has homogeneous grammage over at least 90% of its surface, more advantageously over 90-95% of its surface, ideally 100%. Homogeneous grammage is a grammage that varies by less than 10% over the entire surface of the fibrous deposit, advantageously by less than 5%, ideally 0%. The grammage is to the amount of dry matter forming the fibrous deposit. It is thus the amount of dry matter in aqueous suspension A that has been sprayed onto a substrate.

The grammage of the fibrous deposit DF is advantageously between 0.1 and 50 g/m$^2$, more advantageously between 0.2 and 50 g/m$^2$, more advantageously between 0.2 and 35 g/m$^2$, even more advantageously between 0.5 and 25 g/m$^2$, even more advantageously between 1 and 15 g/m$^2$, even more advantageously between 1 and 12 g/m$^2$, preferably between 1 and 8 g/m$^2$, and even more preferably between 1 and 3 g/m$^2$. It can be comprised in particular between 0.2 and 3 g/m$^2$.

According to a particular embodiment of the invention, step 2/ or 2'/ is carried out preferably 1 to 20 times, more preferably 1 to 15 times, even more preferably 1 to 10 times on the substrate.

Repeating spraying step 2/ or 2'/ may be necessary in order to reach the desired grammage, for instance when deposit DF has a grammage of 0,1 g/m$^2$ or more. Accordingly, the grammage of deposit DF may exceed 50 g/m$^2$. However, it is preferably 20 g/m$^2$ or less, more preferably 10 g/m$^2$ or less.

However, the covering and/or barrier layer of the second embodiment corresponds to a fibrous deposit DF having a grammage advantageously between 0.1 and 30 g/m$^2$, more advantageously between 0.3 and 10 g/m$^2$.

In general, the DF deposit (first or second embodiment) has a thickness that preferably ranges from 0.2 to 50 micrometers, more preferably from 0.5 to 25 micrometers, even more preferably from 1 to 15 micrometers.

Once the fibrous deposit DF is formed, regardless of the substrate, the method may include a step of drying after spraying. Drying can be performed at a temperature advantageously between 20 and 100° C., more advantageously between 40 and 80° C.

As an example, the fiber deposit DF can be dried by the press sections of a paper machine, particularly when the aqueous suspension A comprises 97 parts or less by weight of water, in particular when the substrate is a paper, or cardboard, in the process of being formed.

The scopes of application of the present invention include in particular composite biomaterials, packaging, and more generally in the paper and cardboard industry.

The invention and the advantages deriving therefrom will be better understood from the following figures and examples in order to provide a non-limiting illustration of the invention.

DETAILED DESCRIPTION

Figure 1:
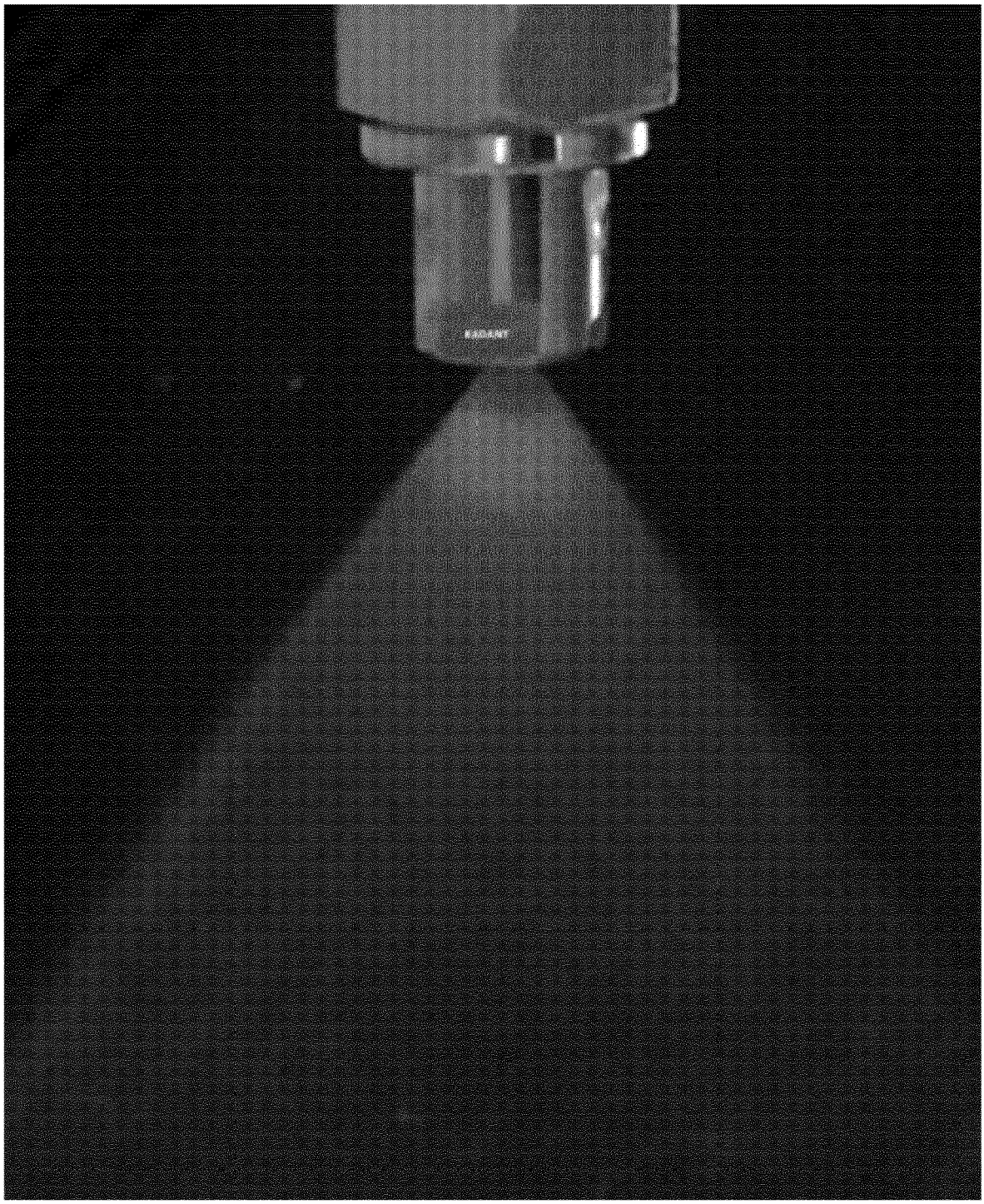
FIG. 1 shows the spraying, at a pressure no lower than 3 MPa, of a cellulosic fiber composition according to the method that is the subject matter of the invention.

A composition of cellulosic fibers was deposited on a substrate (80 g/m$^2$ printing and writing paper) according to the following steps:

a) preparation of an aqueous suspension SA comprising, by weight:
95% at least of water,
1 to 2% of calcium carbonate,
3 to 4% of cellulosic fibers from MOW (Mixed Office Waste containing 85 wt % fibers and 15 wt % fillers in water), b) spraying of the aqueous suspension SA onto 80 g/m$^2$ printing and writing paper, the spray pressure being 95 bar with a flow rate of 2.3 L/min, c) drying in open air at 30° C. for 25 minutes, d) obtaining a fibrous deposit DF of 1.5 g/m$^2$ on 80 g/m$^2$ printing and writing paper.

The spraying nozzle has a size of 600 micrometers. The cellulosic fibers have an average length of 400 micrometers.

Figure 2:
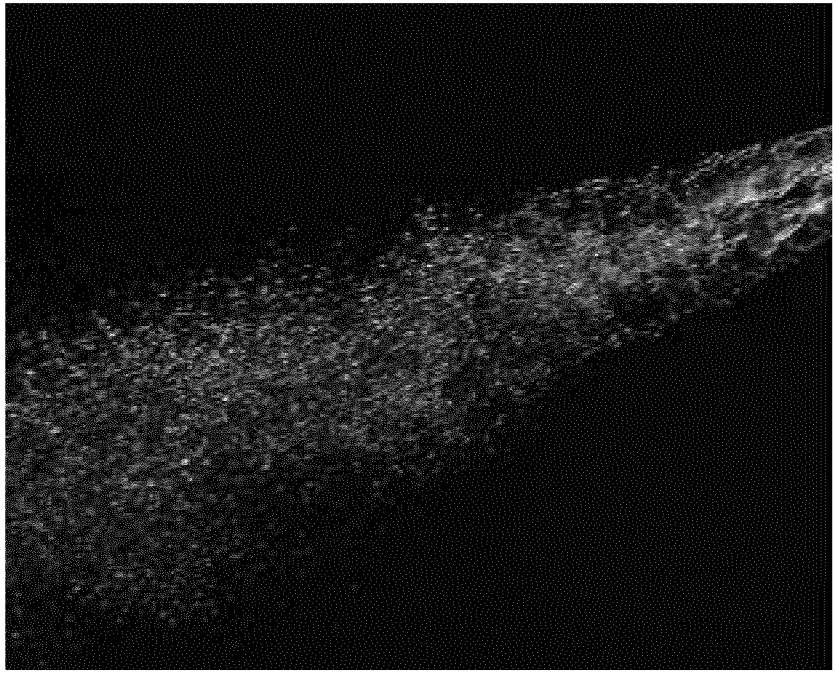
FIG. 2 shows the spray coating of a cellulosic fiber composition.

This deposit is shown by FIG. 1. The spraying conditions produce microdroplets while the conditions of the prior art (spray coating, FIG. 2) produce large, irregularly sized drops.

The same procedure was followed in order to prepare the deposits of Tables 1 and 2.

TABLE 1

Cellulosic fiber films

| Sample | Technology | Fibers | Fibers/ Fillers | wt % fillers in water | Fillers | Deposit (g/m$^2$) | Thickness (μm) |
|---|---|---|---|---|---|---|---|
| 1 | Invention | BEKP | 100/0 | 0 | | 28 | 17 |
| 2 | Invention | BEKP | 100/0 | 0 | | 50.6 | 22 |
| 3 | Invention | BEKP | 100/0 | 0 | | 88.3 | 93 |
| 4 | Invention | BEKP | 100/0 | 0 | | 57.4 | 27 |
| 5 | Invention | BEKP | 100/0 | 0 | | 58 | 22 |
| 6 | Invention | BEKP | 100/0 | 0 | | 62.1 | 24 |
| 7 | Invention | BEKP | 100/0 | 0 | | 90.8 | 32 |
| 8 | Invention | BEKP | 100/0 | 0 | | 56.6 | 27 |
| 9 | Coating | BEKP | 100/0 | 0 | | 1 | 6 |
| 10 | Coating | OCC | 90/10 | 11 | Pigment | 1.5 | 6 |

TABLE 1-continued

| Cellulosic fiber films | | | | | | | |
|---|---|---|---|---|---|---|---|
| Sample | Technology | Fibers | Fibers/ Fillers | wt % fillers in water | Fillers | Deposit ($g/m^2$) | Thickness (μm) |
| 11 | Coating | BEKP | 20/80 | 80 | Calcium carbonate | 15 | 36 |
| 12 | Coating | BEKP | 20/80 | 80 | Calcium carbonate | 10 | 18 |
| 13 | Coating | BEKP | 20/80 | 80 | Calcium carbonate | 5 | 12 |

BEKP Bleached Hardwood Kraft Pulp: cellulose fibers having a mean size of 200 micrometers
OCC Old Corrugated Cardboard: cellulose fibers having a mean size of 200 micrometers
Fillers Pigment and Calcium carbonate having a mean size of 10 micrometers

TABLE 2

| Spraying conditions | | | | | | |
|---|---|---|---|---|---|---|
| Sample | Nozzle | Pressure (bar) | Distance between the nozzle and the substrate (cm)/nozzle size (μm) | Number of spray(s) | Drying (° C.) | Substrate |
| 1 | 25.13 | 60 | 50/550 | 15 | 100 | Nylon |
| 2 | 25.13 | 120 | 50/550 | 15 | 100 | Nylon |
| 3 | 30.13 | 60 | 50/610 | 15 | 100 | Nylon |
| 4 | 30.13 | 120 | 50/610 | 15 | 100 | Nylon |
| 5 | 25.13 | 60 | 50/550 | 15 | 25 | Glass |
| 6 | 25.13 | 120 | 50/550 | 15 | Ambient25 | Glass |
| 7 | 30.13 | 60 | 50/610 | 15 | Ambient25 | Glass |
| 8 | 30.13 | 120 | 50/610 | 15 | Ambient25 | Glass |
| 9 | 25.13 | 40 | 55/550 | 1 | 105 | Paper |
| 10 | 25.13 | 40 | 50/550 | 1 | 25 | OCC |
| 11 | 25.13 | 40 | 50/550 | 15 | 50 | OCC |
| 12 | 25.13 | 40 | 50/550 | 10 | 50 | OCC |
| 13 | 25.13 | 40 | 50/550 | 5 | 50 | OCC |

1 bar = 0.1 MPa

The nozzle type are 25 or 30 and is defining the nozzle type and average diameters.

TABLE 3

| Nozzle features | | |
|---|---|---|
| Nozzle Type | Equivalent diameter in μm | Spray angle in ° |
| 25.11 | 550 | 60° |
| 25.13 | 550 | 67° |
| 30.11 | 610 | 60° |
| 30.13 | 610 | 67° |

The invention claimed is:

1. A method for depositing, on a substrate, a composition of cellulosic fibers, comprising the following steps:

1/ preparing an aqueous suspension SA comprising at least cellulosic fibers,

2/ spraying, at a pressure between 3 MPa and 50 MPa and a spray rate between 1 and 10 L/min, the aqueous suspension SA onto a substrate, wherein the spraying is carried out by means of a nozzle having a size between 0.05 millimeter and 3 millimeters, 3/ obtaining a fibrous deposit DF on the substrate, the aqueous suspension SA comprising between 3 and 20% by weight of cellulosic fibers relative to the total weight of the aqueous suspension SA.

2. The method according to claim 1, wherein the cellulosic fibers have an average length between 50 micrometers and 5 millimeters.

3. The method according to claim 1, wherein, for 100 parts by weight of dry matter of the aqueous suspension SA, the cellulosic fibers account for 3 to 100 parts by weight.

4. The method according to claim 1, wherein the aqueous suspension SA also comprises mineral fillers.

5. The method according to claim 1, wherein the aqueous suspension SA comprises mineral fillers, these mineral fillers accounting for 5 to 97 parts by weight for 100 parts by weight of dry matter of the aqueous suspension SA.

6. The method according to claim 1, wherein the substrate is paper or cardboard.

7. The method according to claim 1, wherein the spraying of step 2/is carried out by means of a nozzle having a size between 0.1 millimeter and 2.0 millimeters.

8. The method according to claim 1, wherein the fibrous deposit DF has homogeneous grammage over at least 90% of its surface, homogeneous grammage being grammage that varies by less than 5% over the entire surface of the fibrous deposit DF.

9. The method according to claim 1, wherein the fibrous deposit DF has a grammage between 0.2 $g/m^2$ and 50 $g/m^2$.

10. The method according to claim 1, wherein the spraying of aqueous suspension SA results in microdroplets having a size between 1 and 800 micrometers.

11. The method according to claim 1, wherein the DF deposit has a thickness that ranges from 0.2 to 50 micrometers.

12. The method according to claim 1, wherein step 2/ is carried out 1 to 20 times on the substrate.

13. A method for forming, on a substrate, a barrier layer comprising the following steps:

1'/ preparing an aqueous suspension SA comprising between 3 and 20% by weight of cellulosic fibers relative to the total weight of the aqueous suspension SA, 2'/ depositing by spraying, at a pressure between 3 MPa and 50 MPa and a spray rate between 1 and 10 L/min, the aqueous suspension SA onto a substrate, wherein the spraying is carried out by means of a nozzle having a size between 0.05 millimeter and 3 millimeters, 3'/ obtaining a barrier layer made up of a fibrous deposit DF on the substrate.

* * * * *